United States Patent [19]

Nichols

[11] 4,385,534

[45] May 31, 1983

[54] ADJUSTABLE SOCKET

[76] Inventor: Carl R. Nichols, R.D. #2, Campbell, N.Y. 14821

[21] Appl. No.: 181,907

[22] Filed: Aug. 27, 1980

Related U.S. Application Data

[63] Continuation of Ser. No. 969,853, Dec. 15, 1978, abandoned.

[51] Int. Cl.[3] ..... B25B 13/32
[52] U.S. Cl. ..... 81/114
[58] Field of Search ..... 81/113, 114; 279/42, 279/48

[56] References Cited

U.S. PATENT DOCUMENTS

| | | | |
|---|---|---|---|
| 1,041,858 | 10/1912 | Normoyle | 81/114 UX |
| 1,268,171 | 6/1918 | Spaulding | 279/42 |
| 1,765,362 | 6/1930 | Berry | 279/48 |
| 2,561,407 | 7/1951 | Palmer | 81/113 |
| 3,738,768 | 6/1973 | Kuhn | 279/42 X |

*Primary Examiner*—James G. Smith
*Attorney, Agent, or Firm*—Epstein & Edell

[57] ABSTRACT

An adjustable socket for engaging hardware of various metric and standard sizes includes a body having integral resilient jaws and a threaded cam sleeve rotatably mounted on the body and having an inner tapered surface positioned such that rotation of the sleeve brings the inner surface to bear against the jaws to position the jaws to define driving end openings of various sizes.

1 Claim, 7 Drawing Figures

ADJUSTABLE SOCKET

This application is a continuation of application Ser. No. 969,853, filed Dec. 15, 1978, now abandoned.

BACKGROUND OF THE INVENTION

1. Field of the Invention

The present invention pertains to sockets for turning hardware, such as nuts and bolts, and, more particularly, to an adjustable socket variable over a range of sizes to permit a single socket to be used in place of several ordinary sockets of metric and standard sizes.

2. Discussion of the Prior Art

A standard item in automobile and other mechanic's tool chests is a complement of socket wrenches ranging from approximately ¼ inch to 1 inch in 1/16-inch increments, socket wrenches being probably the most frequently used tools in general automotive work. The modern mechanic also usually requires a set of metric sockets covering generally the same range for use on metric size nuts and bolts found in foreign cars and domestic cars having foreign-made engines and other components. Consequently, a mechanic's tools may include twenty to thirty individual sockets which must be kept clean and at hand, adding to the mechanic's burden, especially when he is working in the field and must carry his tools with him.

Adjustable tools designed to replace several tools of fixed sizes are popular with mechanics because they help reduce the mechanic's load and minimize the number of items with which he must concern himself. Adjustable tools also help eliminate the time often lost by the mechanic who, thinking he has a 9/16-inch nut to remove, finds, after locating his 9/16 wrench, that the nut was actually a ½-inch or 13 mm size and, therefore, must return to his toolbox to locate the proper tool, hopefully on the second try. Examples of common adjustable tools are pliers and adjustable (crescent) wrenches; however, while adjustable sockets have been proposed, such adjustable sockets have had inherent disadvantages which have prevented their general acceptance in the market. U.S. Pat. Nos. 1,482,075 to Fisher, 2,555,836 to Werich, 2,582,444 to Lucht, 2,701,489 to Osborn, 2,850,931 to Conway, 2,884,826 to Bruhn and 3,724,299 to Nelson are exemplary of such prior art adjustable sockets. Some of the disadvantages of prior art adjustable sockets are that they have invariably been of a relatively complex design requiring many parts and, therefore, having limited durability as well as being expensive to manufacture. Sockets are subject to rough handling and must be durable to withstand such handling as well as to withstand use in dirty, grimy conditions which can cause parts to fail to cooperate as desired. Additionally, sockets are subject to large forces in use and must be extremely sturdy; and, the more parts required, the greater the opportunity for failure of adjustable sockets.

SUMMARY OF THE INVENTION

Accordingly, it is a primary object of the present invention to overcome the above mentioned disadvantages of the prior art by constructing an adjustable socket of only two parts to increase strength and durability while facilitating use and cleaning.

Another object of the present invention is to construct an adjustable socket of an outer cam sleeve mounted on a body having spaced jaws defining a driving end opening, the cam sleeve having an inner tapered surface for engaging the jaws such that movement of the cam sleeve axially along the body controls jaw spacing.

The present invention has a further object in the use of spring snap rings between a body in an outer cam sleeve to control axial positioning of the cam sleeve on the body, the cam sleeve controlling the spacing of jaws extending along the body to define a driving end opening.

Yet another object of the present invention is to provide a socket that is continuously adjustable over a range of sizes and may therefore be used to apply a gripping or clamping force to hardware.

A further object of the present invention is to construct an adjustable socket of an outer cam sleeve and a body with jaws having tapered outer surfaces to establish a bearing point axially spaced from the jaw tips to prevent the cam sleeve from interfering with the hardware.

Some of the advantages of the present invention over the prior art are that the adjustable socket of the present invention is inexpensive to manufacture in that the adjustable socket is formed of only two parts, neither of which requires intricate machining, is sturdy and durable to be continuously operable in harsh working conditions and when subject to large forces, can be easily adjusted at all times due to the requirement of only a simple axial movement of a sleeve along a body to vary the spacing between jaws to define various driving end opening sizes, and is continuously adjustable over a range of sizes to permit a single socket to be used interchangeable to turn and/or clamp standard, metric and odd-size hardward thereby substantially reducing the number of tools that a mechanic must carry and care for.

The present invention is generally characterized in an adjustable socket including a body having a driven end with an opening therein for receiving a driving tool, a midsection, and a plurality of spaced resilient jaws extending from the midsection in substantially parallel relation with the longitudinal axis of the body and terminating at ends defining a driving end opening for receiving hardware to be driven, the driven end, midsection and jaws of the body being integrally formed, and a cam sleeve disposed around the body to be axially movable therealong and having a tapered camming surface abutting the jaws whereby axial movement of the cam sleeve along the body varies the spacing between the jaws to vary the size of the driving end opening.

Other objects and advantages of the present invention will become more apparent from the following description of the preferred embodiments taken in conjunction with the accompanying drawings.

DESCRIPTION OF THE PREFERRED EMBODIMENTS

Figure 1:
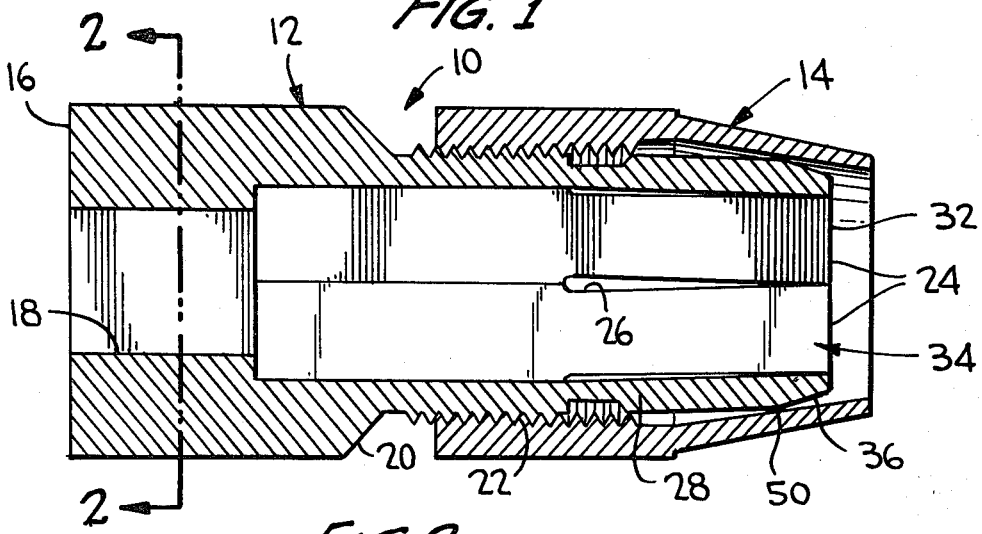
FIG. 1 is a longitudinal section of the adjustable socket of the present invention.
Figure 2:
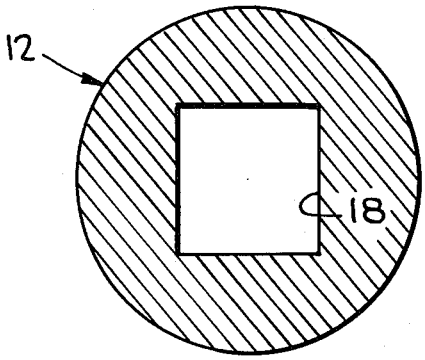
FIG. 2 is a section taken along line 2—2 of FIG. 1.
Figure 4:
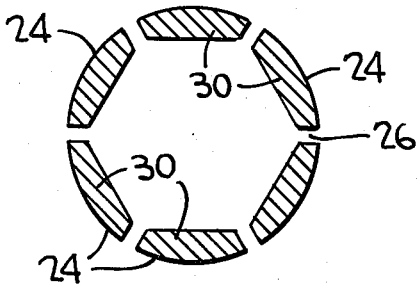
FIG. 4 is a section taken along line 4—4 of FIG. 3.
Figure 3:
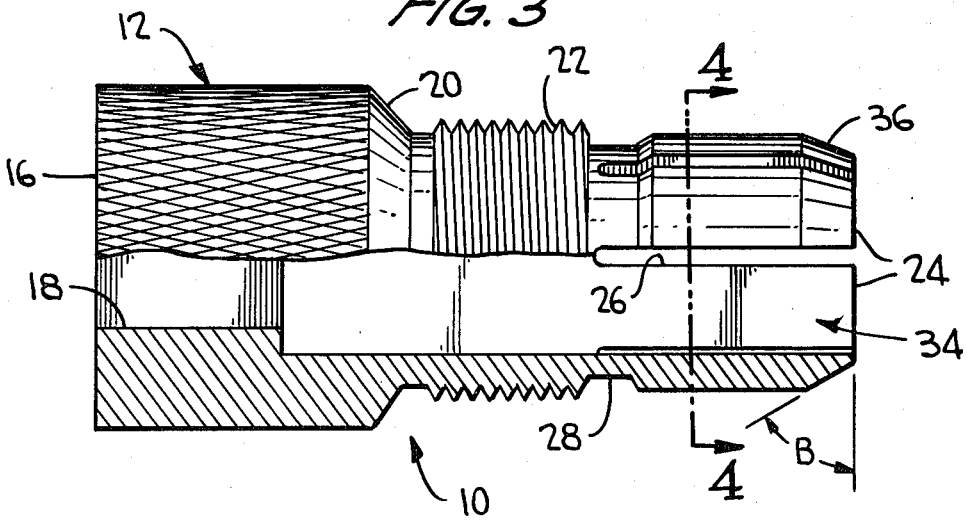
FIG. 3 is a longitudinal section of the body of the adjustable socket of FIG. 1.

Referring to FIG. 1, a socket assembly 10 according to the present invention is formed of a body 12 and a cam sleeve 14 threadedly engaging the body. The body 12, as shown in FIG. 3, is a one-piece structure of generally cylindrical shape having a driven end 16 with an opening 18 therein for receiving a driving tool, not shown. The opening 18 is preferably square in cross section, as shown in FIG. 2, to receive a conventional socket drive tool; for example, being a $\frac{3}{8}$ inch or $\frac{1}{4}$ inch square drive female throughhole. The body 12 has a midsection 20 carrying exterior threads 22, and a plurality of spaced, resilient jaws 24 are formed integrally on the body extending from the midsection 20 substantially parallel to the longitudinal axis of the body. The jaws 24 are spaced from one another by axially extending slots 26 to permit inward deflection of the jaws by the cam sleeve 12. An annular external groove 28 is disposed between the threaded portion of the body and the jaws 24 to provide increased resiliency for the jaws. Each jaw has a flat, planar inner surface 30 disposed substantially parallel to the longitudinal axis of the body, the jaws terminating at ends 32 defining a driving end opening 34 for receiving hardware, such as nuts and bolts, to be driven. Each of the jaws has an outer surface 36 which is inwardly tapered from a point 50 toward the end 32 to define arcuate points for contacting a camming surface of cam sleeve 14, the jaws forming segments of a circle arranged transverse to the longitudinal axis of body 12 with arcuate points 50 spaced from the ends of the jaws, as best shown in FIGS. 3 and 4. The thickness of the jaws 24 and the depth of the annular groove 28 are selected so as to maximize the strength of the socket while retaining sufficient resilience to permit the use of the socket over a sufficiently broad range of driving end opening sizes.

Figure 5:
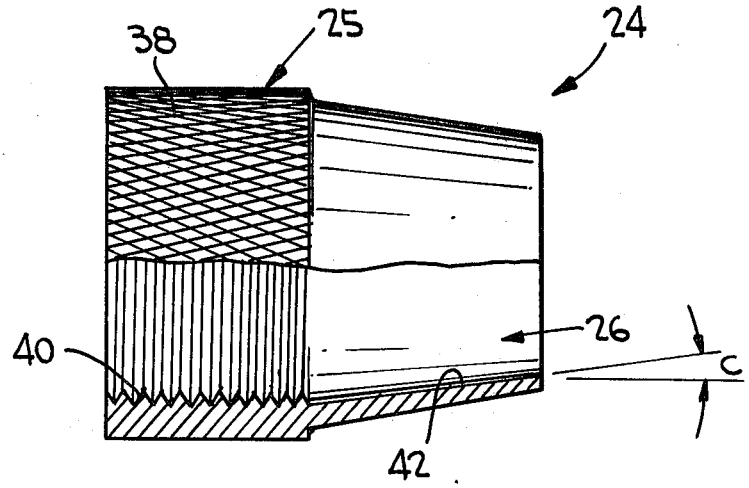
FIG. 5 is a partial longitudinal section of the cam sleeve of the adjustable socket of FIG. 1.

The cam sleeve 14, as shown in FIGS. 1 and 5, has a knurled outer gripping surface and carries internal threads 40 for threadedly engaging the external threads 22 on the body 12. The cam sleeve 14 has a tapered camming surface 42 decreasing in diameter away from the internal threads 40, the camming surface being oriented at an included angle with the longitudinal axis of the cam sleeve within the range of from 3° to 11° and preferably at an included angle of approximately 7°, the included angle being denoted at C in FIG. 5. The angular orientation of of the camming surface 42 combined with the lead of the threads 22 and 40 determines the incremental change in socket size for a single revolution of the cam sleeve 14, the orientation of the camming surface being preferably maintained at a small angle to increase precision operation and facilitate movement of the cam sleeve axially along the body.

The body 12 and cam sleeve 14 are each drop forged of a tool-grade steel to produce integral, one-piece units; however, any other appropriate method and/or material could be used to produce the adjustable socket of the present invention.

In operation, the cam sleeve is disposed around the body to be axially movable therealong by rotation via the engagement of threads 22 and 40 until the camming surface 42 initially abuts or bears against the outer surfaces of the jaws 24 at contact points 50. Thereafter, additional clockwise rotation of the cam sleeve will deform the jaws inwardly, as illustrated in FIG. 1, due to the camming surface 42 engaging the outer surface of the jaws at contact points 50 spaced from the ends 32 thereby varying the spacing between the jaws to vary the size of the driving end opening 34. In this manner, the size of the socket can be continuously adjusted over a range from fully open to a point where the jaws are compressed to abut one another. The location of contact points 50 at a position spaced from the ends of the jaws allows the cam sleeve to move axially along its operating range without obstructing the ends of the jaws or the hardware being driven. The range of sizes accommodated by the adjustable socket 10 is determined by the angle of the camming surface, the lead and length of the thread portions and the spacing 26 between the jaws; however, it is important that, while the jaws be resilient in nature, they are sufficiently strong to withstand great forces.

Figure 6:
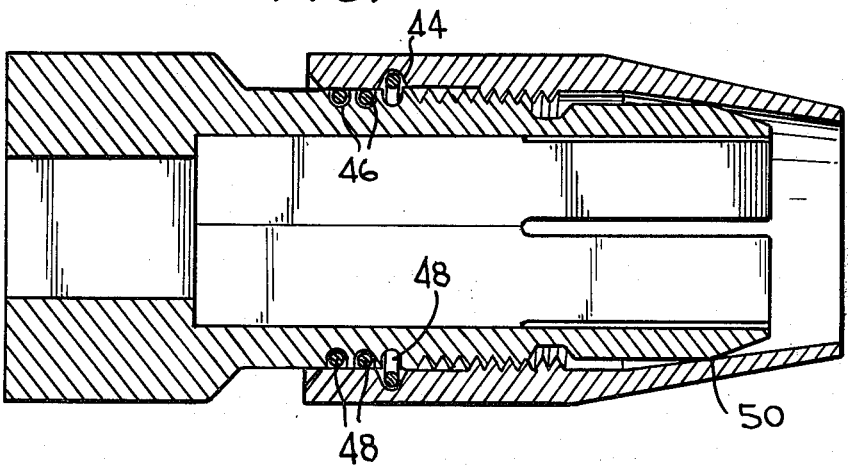
FIG. 6 is a longitudinal section of a modification of the device shown in FIG. 1.
Figure 7:
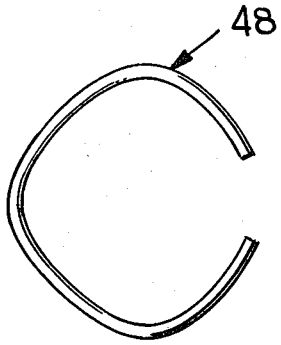
FIG. 7 is a view of the detent mechanism of the embodiment shown in FIG. 6.

The modification illustrated in FIG. 6 provides a detent structure to precisely position the cam sleeve relative to the body for specific standard and metric size driven end openings, the parts of FIG. 6 identical to parts of the embodiment of FIGS. 1 through 5 being given identical members and not described again.

The detent structure is produced by forming an internal circumferential detent groove 44 in the cam sleeve 14 having angled side walls, as shown and forming external circumferential detent grooves 46 in the midsection 20 of the body 12, and spring snap rings 48 are mounted in each of the external grooves 46 betweem the cam sleeve and the body such that when the internal groove 44 is aligned with any of the external grooves 46, the snap ring 48 will expand into the internal groove to hold the sleeve in place and thereby precisely axially position the sleeve along the body and, accordingly, produce a driving end opening 34 of a specific size.

The operation of the modification of FIG. 6 is similar to that described above with respect to the embodiment of FIGS. 1 through 5 with the exception that a mechanic can feel the detent operation of the snap rings expanding into the internal grooves thereby producing an indication that the socket has been adjusted to a specific size opening. The angled side walls of the internal groove 44 provide a camming action to cause the snap rings to return to their respective external grooves with axial movement of the cam sleeve. If desired, indicia can be positioned along the midsection of the body to indicate the size opening of the socket in accordance with axial movement of the cam sleeve.

The adjustable socket 10 can be used, not only as a substitute for ordinary sockets, that is, as a socket to engage the ends of nuts, bolts, or other hardware to be held or driven, but also as a clamp by positioning the adjustable socket over the hardware and then advancing the cam sleeve on the body to offset a gripping action of the jaws on the hardware. Thus used, the adjustable socket is useful in many commonly encountered situations, such as where a nut has to be threaded onto a bolt in an area where there is no room for a mechanic's fingers or where a bolt must be held against rotation on one side of a panel while a nut is turned onto the bolt from the opposite side.

Inasmuch as the present invention is subject to many variations, modifications and changes in detail, it is intended that all subject matter discussed above or shown in the accompanying drawings be interpreted as illustrative and not in a limiting sense.

What is claimed is:

1. An adjustable socket comprising a body having a driven end with an opening therein for receiving a driving tool, a midsection, and a plurality of spaced resilient jaws extending from said midsection in substantially parallel relation with the longitudinal axis of said body and terminating at ends defining a driven end opening for receiving hardware to be driven, said body being integrally formed and having a plurality of circumferential external grooves therein;

a cam sleeve disposed around said body to be axially movable therealong and having an internal circumferential detent groove therein and a tapered camming surface abutting said jaws whereby axial movement of said cam sleeve along said body varies the spacing between said jaws to vary the size of said driving end opening; and a plurality of spring snap rings each positioned in a compressed condition in one of said external grooves in said body to engage said internal groove in said cam sleeve when said internal groove is aligned with each of said external grooves as said cam sleeve is axially moved along said body to positively position said jaws for various size driving end openings.

* * * * *